United States Patent [19]

Mitchell

[11] Patent Number: 4,589,778

[45] **Date of Patent: * May 20, 1986**

[54] STIRRING DEVICE FOR SAND MILL

[76] Inventor: Phillip G. Mitchell, P.O. Box 612, Opelika, Ala. 36801

[ * ] Notice: The portion of the term of this patent subsequent to Feb. 12, 2002 has been disclaimed.

[21] Appl. No.: 689,990

[22] Filed: Jan. 9, 1985

Related U.S. Application Data

[63] Continuation of Ser. No. 610,783, May 16, 1984, Pat. No. 4,499,445.

[51] Int. Cl.[4] ..... B01F 7/16

[52] U.S. Cl. ..... 366/316; 416/195; 416/237; 416/241 A

[58] Field of Search ..... 366/315, 316, 317, 326, 366/328, 330, 331, 342, 343, 325, 279, 327, 329, 265, 263; 416/237 R, 181, 195, 241 A, 244 R

[56] References Cited

U.S. PATENT DOCUMENTS

| | | | |
|---|---|---|---|
| 3,134,549 | 5/1964 | Quackenbush | 366/315 |
| 3,135,474 | 6/1964 | Schold | 366/315 |
| 3,630,636 | 12/1971 | Hill | 416/181 |
| 4,106,116 | 8/1978 | Mackay | 366/315 |
| 4,305,673 | 12/1981 | Herbst | 366/317 |

*Primary Examiner*—Robert W. Jenkins

*Attorney, Agent, or Firm*—Newton, Hopkins & Ormsby

[57] ABSTRACT

A stirring device attached to the vertical shaft of a sand mill having an annular metal collar received on the shaft and a flat, plastic, circular disc extending radially beyond the collar for a stirrer member concentrically affixed to the radial surface of the collar. The stirrer member has an outer ring and a central hub which are joined by circumferentially spaced spokes.

4 Claims, 4 Drawing Figures

STIRRING DEVICE FOR SAND MILL

This is a continuation of application Ser. No. 610,783, filed 5/16/84, now U.S. Pat. No. 4,499,445.

BACKGROUND OF THE INVENTION

1. Field of the Invention

This invention relates to a stirring assembly and is more particularly concerned with a Stirring Device for Sand Mill.

2. Discussion of the Prior Art

A sand mill is a stirring machine in which viscous liquid or slurries, such as paints, are mixed, the sand or glass beads therein being used to break up, mix and disperse the liquid or slurry. A sand mill, in the past, has had a plurality of unitary metal mixing or stirring devices which are arranged in vertically spaced relationship on a vertically disposed shaft. Each mixing device has had a hub with spaced spokes and an outer ring or annulus or ring.

Such a prior art stirring element must be replaced about each twelve hundred hours of use. This entails substantial down time. The stirring device of the present invention will last at least five times as long as the prior art stirring device and is less expensive.

SUMMARY OF THE INVENTION

Briefly described, the present invention is a stirring device which replaces the conventional stirring device of a conventional sand mill. This present stirring device has a metal, annular, cylindrical collar, removeably received on the vertical drive shaft of the mill. The bottom portion of the collar is of reduced diameter to provide a central collar extention which receives thereon the stirring member.

The stirring member is a flat, plastic, disc shaped, molded or cast element having a central hub removeably carried by the collar. Circumferentially spaced, spokes radiate from the hub. These spokes are each generally trapezoidal in cross-section. The outer portions of the spokes carry an annular rim. The stirring member is mounted radially on the end of the hub by machine screws which protrude through the hub and are threadedly received in the collar. The stirring member is made of nylon or some other tough castible plastic.

The stirring member made according to my invention will cost approximately one half the cost of a conventional stirring device, last at least five times as long and has a stirring member which can be everted on the collar.

Accordingly, it is an object of the present invention to provide a stirring assembly which is inexpensive to manufacture, durable in structure and efficient in operation.

Another object of the present invention is to provide a stirring device which can replace the stirring device in a conventional sand mill and will have a longer useful life.

Another object of the present invention is to provide a stirring device which can be quite easily and inexpensively manufactured.

Other objects, features and advantages of the present invention will be come apparent from the following description when taken in conjunction with the accompanying drawing wherein like characters of reference designate corresponding parts throughout the several views.

DESCRIPTION OF THE PREFERRED EMBODIMENT

Figure 1:
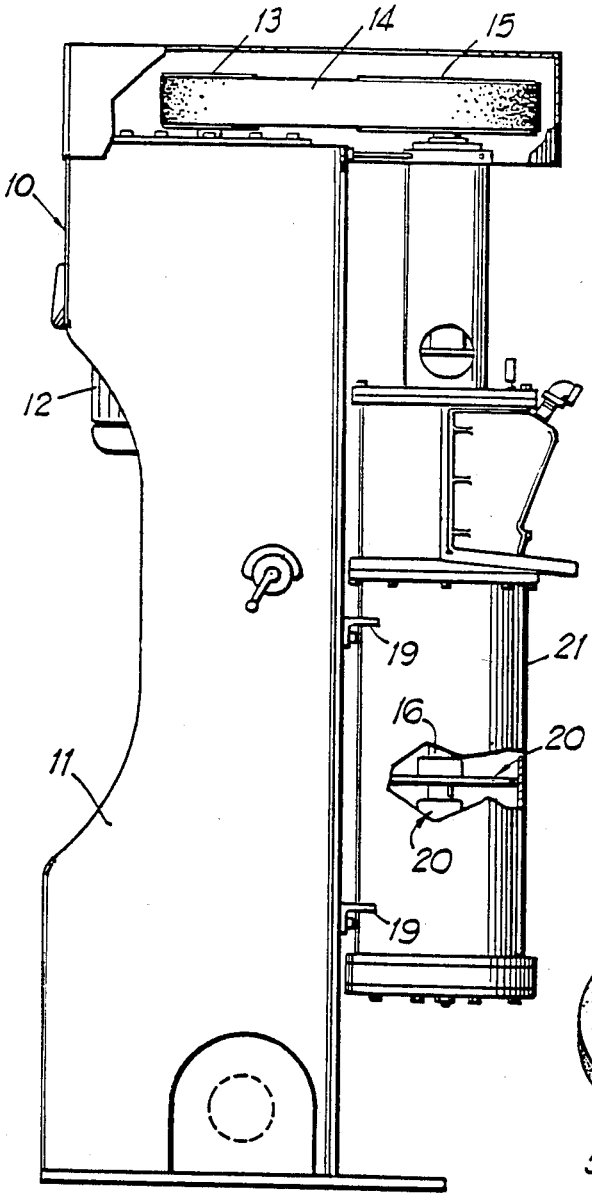
FIG. 1 is a partially broken away side elevational view of a sand mill which has installed thereon a stirring device constructed in accordance with the present invention.
Figure 2:
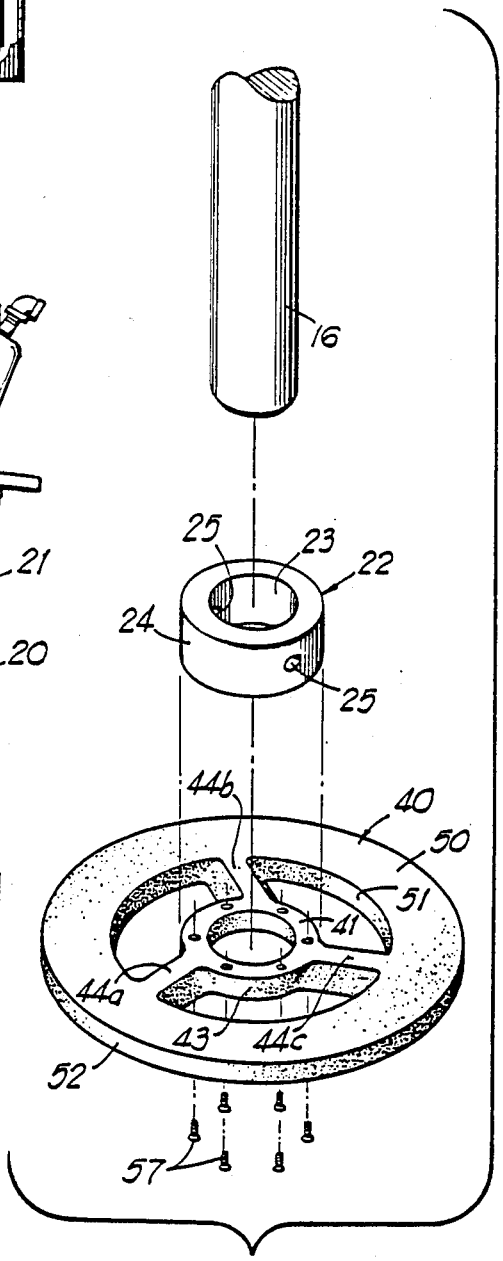
FIG. 2 is a fragmentary exploded perspective view of the stirring device of the present invention installed on the shaft of the sand mill of FIG. 1.
Figure 3:
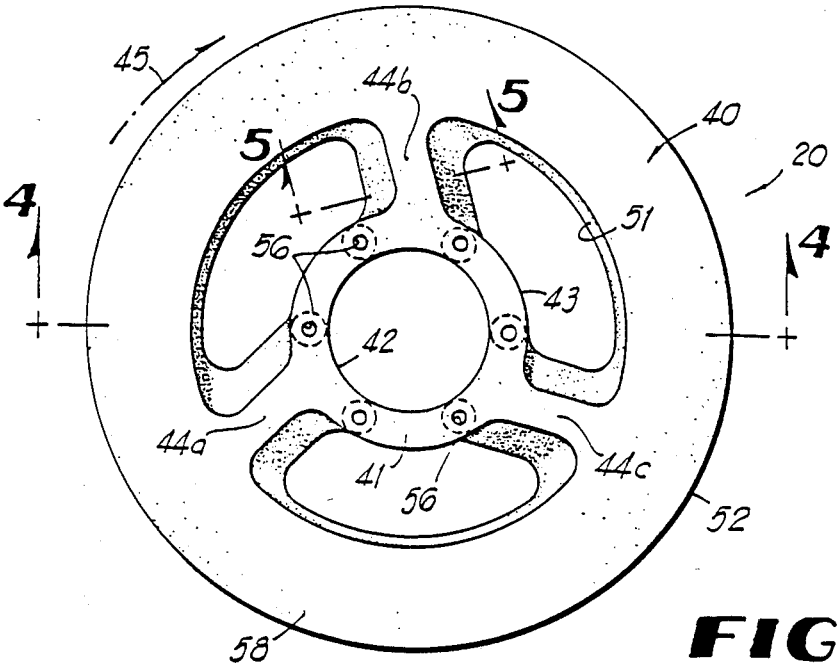
FIG. 3 is a top plan view of the stirring element of the stirring device of FIGS. 1 and 2.

Referring now in detail in the embodiment chosen for the purpose of illustrating the present invention, the embodiment being the best mode contemplated by the inventor for carrying out the claimed invention, numeral 10 denotes a conventional sand mill or vertical stirrer. This sand mill 10 has a body 11 supporting a motor 12 driving a pulley 13. The pulley 13, in turn, drives a continuous belt 14 to rotate a pulley 15. The pulley 15 drives a vertical drive shaft shaft 16 on which are installed a plurality of vertically spaced stirring devices, constructed in accordance with the present invention, denoted generally by the numeral 20. Each stirring device 20 is identical and is rotated within a cylindrical container 21 which is removeably supported on the housing 11 by means of brackets 19. The sand mill 10 is conventional and, therefore, no more detailed description of the sand mill 10 is necessary, except to state that it is also conventional to utilize glass beads in the liquid container 21 and to install therein liquids which are to be stirred and disbursed, due to the rotation of the mixing devices 20, these mixing devices 20 being vertically spaced from each other along the common shaft 16 and being rotated along a common vertical axis defined by the shaft 16.

Figure 4:
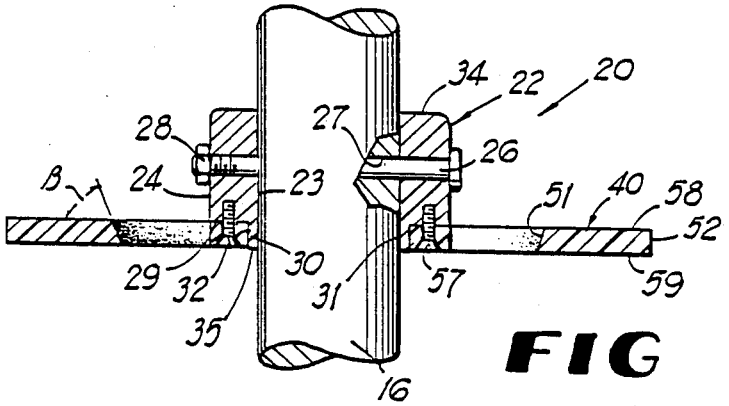
FIG. 4 is a vertical sectional view taken substantially along line 4—4 in FIG. 3.

According to the present invention, each stirring device 20 includes a hollow, cylindrical, metal annular collar 22 which has a central circular hole defined by an inside cylindrical, peripheral, surface 23 which is of a diameter slightly larger than the outside diameter of the shaft 16. Thus, the collar 22 can be inserted snugly onto the shaft 16 and removed therefrom. The collar 22 also has an outer, cylindrical, peripheral surface 24 which is concentric within surface 23. Diametrically opposed holes 25 in collar 22 receive a pin 26, as seen in FIG. 4, which also passes through a hole 27 in shaft 16 and secures pin 26 in place. In the present embodiment, the pin 26 is a bolt having a threaded nut 28 thereon.

The lower or outer end portion of the collar 22 is turned down so as to provide a central collar extension 30. This collar extension 30 has an inside, cylindrical, peripheral, surface 31 which is the same diameter as the surface 23 and is a coaxial extension for defining the bottom portion of the central hole. The outside, cylindrical, peripheral, surface 32 of extension 30 is of a larger diameter than inside surface 31 and is concentrically disposed with respect thereto. Also, the outside surface 32 is of a smaller diameter than outside surface 24. Extending between the lower end of the outside surface 24 and the upper edge of the outside surface 32, is a flat, radially extending, abutment or base or stirrer member mounting surface 29 which is parallel to the upper flat radial surface 34 of the collar 22. The outer or bottom surface 35 of the extension 30 is offset from but parallel to the surface 29 and 34. The cylindrical surface 32 is concentric with the cylindrical surface 24 and the cylindrical surfaces 23 and 30.

Mounted on the extension 30 is a flat, circular, unitary, radially extending, disc shaped stirrer member, denoted generally by the numeral 40. This stirrer or stirring member 40 is a molded or cast plastic member, preferably formed of nylon. Some other tough durable plastic, such as ABS can be substituted for the nylon. In more detail, the stirrer member 40 is of uniform thickness, having a thickness approximately equal to the length of extension 30. Member 40 includes a central hub 41 which has a central circular hole defined by an inner peripheral surface 42 which has a diameter approximately equal to or slightly larger than the outside diameter of surface 32. The hub 41 thus has planar parallel inner and outer surfaces 58 and 59 and also includes an outer cylindrical, peripheral surface which is concentric with the inner peripheral surface 42.

Figure 5:
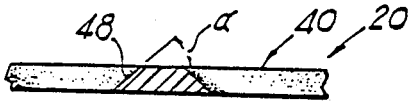
FIG. 5 is a vertical sectional view taken substantially along line 5—5 in FIG. 3.

Protruding outwardly from the hub 41 are a plurality of spokes denoted respectively by the numerals 44*a*, 44*b* and 44*c*. These spokes are circumferentially equally spaced from each other. Each spoke, instead of extending radially outwardly, extends at an angle of about 70° to the tangent of the hub 41, the disc being designed to rotate in a clockwise direction, as indicated by arrow 45, so that the materials to be mixed are directed generally outwardly by each of these spokes 44*a*, 44*b*, 44*c*. Each spoke is identical in construction and, as seen in FIG. 5, the spokes, such as spoke 44*a*, are each trapezoidal in shape, the inclined side surfaces being inclined from the plane of member 40 each at an angle such as angle $\alpha$ in FIG. 5, of approximately 38°. The outer end portions of the spokes 44*a*, 44*b* and 44*c* carry an annular outer ring or annulus, denoted by the numeral 50.

This outer ring 50 has an inner peripheral surface 51 and an outer peripheral surface 52, the surface 52 being concentric with surface 31. The inner peripheral surface 51 is inclined at an angle $\beta$ of about 70° to the plane of the stirrer member 20. The surfaces 48 of the spokes 44*a*, 44*b*, 44*c* and the inner periphery 51 taper downwardly toward each other and the outer peripheral surface 52 of the annular member 50 is cylindrical and concentric with the cylindrical outer and inner peripheral surfaces 42 and 43 of the hub 41. The radial width of the hub 41 is approximately equal to the radial width of surface 29 while the radial width of the annulus or outer ring 50 is wider than the width of hub 41.

The hub 41 is provided with a plurality of circumferentially spaced axially extending holes 56, through which project a like number of machine screws 57 which are threadedly received in the collar 22. Each of these machine screws 57 is countersunk into hub 41, as illustrated in FIG. 4 so that the outer surface of the screw 57 is flush with the outer or bottom surface 58 of the stirrer member. The machine screws 57 project in a radial direction so as to clamp the stirrer member 40 flat against the surface 29. The thickness of the stirrer member 40 is uniform, throughout, and hence the outer surface 58 is parallel to the inner surface 59 of the stirrer member 40.

In some instances, it might be desirable to invert the stirrer member 40 on its collar 22, thereby providing a different stirring pattern and new wearing surfaces. This is simply accomplished by removing the screws 57 and inverting the stirrer member 40. In such a situation, the holes 56 may be countersunk so as to provide for the receiving the machine screws 57, flush therein.

In operation, a plurality of stirrer devices 20 are mounted at spaced intervals along the shaft 16 and locked in place thereon by bolts or pins, such as pin 26. Thereafter, the sand mill is operated in conventional fashion. Of course, it may be found desirable to invert one or more of the stirrer members 40. This can be quite easily accomplished, prior to installation of the particular stirring device 20.

As pointed out above, the stirring device 20 of the present invention will last at least five times as long as a conventional stirring device previously used on the sand mill. Also, only the stirrer member 40 need be replaced, when it has become warn. These stirrer members 40 being essentially unitary cast plastic members are substantially less expensive than the cast unitary type of stirring device previously employed.

It will be obvious to those skilled in the art that many variations may be made in the embodiment here chosen for the purpose of illustrating the present invention, without departing from the scope thereof, as defined by the appended claims.

I claim:

1. A stirring device, for being received on a rotatable shaft of a stirring machine for rotation with the shaft, said shaft protruding into a container in which a stirrable substance is disposed, comprising:

(a) a collar having a central hole therein through which the collar is adapted to receive said shaft, said collar having an outwardly extending base surface;

(b) a circular, unitary, plastic, stirrer member having a hub with a central hole therein conforming to the contour and size of said hole of said collar, said stirrer member having an inner surface along one side thereof, said stirrer member being secured to said central collar so that the central hole of said collar and said stirrer member are concentric;

(c) securing means securing said hub in said collar with said base surface contacting a surface on said hub, said stirrer member extending radially beyond said collar;

(d) said stirrer member including an outer ring spaced radially outward of said collar and said hub, and (e) said stirrer member including means for joining said ring and said hub, said means for joining said ring and said hub having circumferentially spaced openings.

2. The stirring device defined in claim 1 wherein said collar is annular and has an outer periphery, said base surface extending radially beyond said periphery, said base surface of said collar extending radially over and contacting said surface on said hub, the hole in said hub being concentric and abutting the outer periphery of said collar.

3. The stirring device defined in claim 2 wherein said collar is metal.

4. The stirring device of claim 2 wherein said base surface is flat and extends radially outwardly at one end of said collar.

* * * * *